US009883309B2

(12) United States Patent
Samuelsson et al.

(10) Patent No.: US 9,883,309 B2
(45) Date of Patent: Jan. 30, 2018

(54) INSERTION OF SOUND OBJECTS INTO A DOWNMIXED AUDIO SIGNAL

(71) Applicants: DOLBY LABORATORIES LICENSING CORPORATION, San Francisco, CA (US); DOLBY INTERNATIONAL AB, Amsterdam (NL)

(72) Inventors: Leif J. Samuelsson, Amsterdam (NL); Phillip Williams, Alameda, CA (US); Christian Schindler, Amsterdam Zuidoost (NL); Wolfgang A. Schildbach, Amsterdam (NL)

(73) Assignees: Dolby Laboratories Licensing Corporation, San Francisco, CA (US); Dolby International AB, Amsterdam (NL)

( * ) Notice: Subject to any disclaimer, the term of this patent is extended or adjusted under 35 U.S.C. 154(b) by 0 days.

(21) Appl. No.: 15/511,146

(22) PCT Filed: Sep. 23, 2015

(86) PCT No.: PCT/US2015/051585

§ 371 (c)(1),
(2) Date: Mar. 14, 2017

(87) PCT Pub. No.: WO2016/049106

PCT Pub. Date: Mar. 31, 2016

(65) Prior Publication Data

US 2017/0251321 A1 Aug. 31, 2017

Related U.S. Application Data

(60) Provisional application No. 62/055,075, filed on Sep. 25, 2014.

(51) Int. Cl.
*H04S 3/00* (2006.01)
*G10L 19/16* (2013.01)

(52) U.S. Cl.
CPC ..... *H04S 3/008* (2013.01); *G10L 19/167* (2013.01); *H04S 2400/01* (2013.01); *H04S 2400/03* (2013.01); *H04S 2400/11* (2013.01)

(58) Field of Classification Search
CPC .. H04S 3/008; H04S 2400/01; H04S 2400/03; H04S 2400/11; G10L 19/167
(Continued)

(56) References Cited

U.S. PATENT DOCUMENTS 6,311,155 B1 10/2001 Vaudrey
8,520,858 B2 8/2013 Metcalf
(Continued)

FOREIGN PATENT DOCUMENTS

WO 2014/025752 2/2014
WO 2014/099285 6/2014

OTHER PUBLICATIONS

Claypool, B. et al "Auro 11.1 Versus Object-Based Sound in 3D" pp. 1-18, publication date: Unknown.
(Continued)

*Primary Examiner* — Melur Ramakrishnaiah

(57) ABSTRACT

A method for inserting a first audio signal into a bitstream which comprises a downmix signal and associated bitstream metadata is described. The downmix signal and associated bitstream metadata are indicative of an audio program comprising a plurality of spatially diverse audio signals. The downmix signal comprises at least one audio channel and the bitstream metadata comprise upmix metadata for reproducing the plurality of spatially diverse audio signals from the at least one channel. The method comprises mixing the first audio signal with the at least one audio channel to generate a modified downmix signal. The method further comprises generating an output bitstream comprising the
(Continued)

Figure 1:
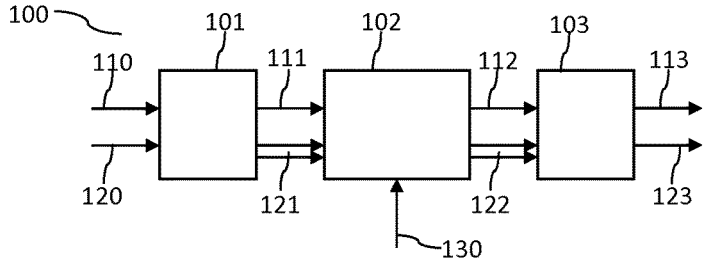

modified downmix signal and the associated modified bitstream metadata indicative of a modified audio program comprising a plurality of modified spatially diverse audio signals.

19 Claims, 2 Drawing Sheets

(58) Field of Classification Search
USPC ..... 381/17, 19, 20, 22, 23, 119, 300, 303
See application file for complete search history.

(56) References Cited

U.S. PATENT DOCUMENTS

2004/0014359 A1 1/2004 Knox
2010/0094443 A1 4/2010 Oh
2011/0013790 A1* 1/2011 Hilpert ..... G10L 19/008 381/300
2011/0029113 A1 2/2011 Ishikawa
2011/0216908 A1 9/2011 Galdo
2012/0082319 A1 4/2012 Jot
2014/0023197 A1 1/2014 Xiang
2015/0350802 A1* 12/2015 Jo ..... H04S 5/005 381/1

OTHER PUBLICATIONS

Carpentier, G. et al "The Interactive-Music Network" DE 4.3.2.—Multimedia Standards for Music Coding, DE4.3.2, Jun. 2005.
Meng, Chen "Virtual Sound Source Positioning for un-fixed Speaker Set Up" University of Wollongong Thesis Collection Department, 2011.

* cited by examiner

INSERTION OF SOUND OBJECTS INTO A DOWNMIXED AUDIO SIGNAL

CROSS-REFERENCE TO RELATED APPLICATIONS

This application claims priority to U.S. Provisional Patent Application No. 62/055,075 filed 25 Sep. 2014 which is hereby incorporated by reference in its entirety.

TECHNICAL FIELD

The present document relates to audio processing. In particular, the present document relates to the insertion of sound objects into a downmixed audio signal.

BACKGROUND

Audio programs may comprise a plurality of audio objects in order to enhance the listening experience of a listener. The audio objects may be positioned at time-varying positions within a 3-dimensional rendering environment. In particular, the audio objects may be positioned at different heights and the rendering environment may be configured to render such audio objects at different heights.

The transmission of audio programs which comprise a plurality of audio objects may require a relatively large bandwidth. In order to reduce the bandwidth of such audio programs, the plurality of audio objects may be downmixed to a limited number of audio channels. By way of example, the plurality of audio objects may be downmixed to two audio channels (e.g. to a stereo downmix signal), to 5+1 audio channels (e.g. to a 5.1 downmix signal) or to 7+1 audio channels (e.g. to a 7.1 downmix signal). Furthermore, metadata may be provided (referred to herein as upmix metadata or joint object coding, JOC, metadata) which provides a parametric description of the audio objects that are comprised within the downmix audio signal. In particular, the upmix or JOC metadata may be used by a corresponding upmixer or decoder to derive a reconstruction of the plurality of audio objects from the downmix audio signal.

Within the transmission chain from an encoder (which provides the downmix signal and the JOC metadata) to a decoder (which reconstructs the plurality of audio objects based on the downmix signal and based on the JOC metadata), there may be the need for inserting an audio signal (e.g. a system sound of a settop box) into the bitstream comprising the downmix signal and the JOC metadata. The present document describes methods and systems which enable an efficient and high quality insertion of one or more audio signals into such a downmix signal.

SUMMARY

According to an aspect a method for inserting a first audio signal into a bitstream which comprises a downmix signal and associated bitstream metadata is described. The downmix signal and the associated bitstream metadata are indicative of an audio program which comprises a plurality of spatially diverse audio signals (e.g. audio objects). The downmix signal comprises at least one audio channel and the bitstream metadata comprises upmix metadata for reproducing the plurality of spatially diverse audio signals from the at least one audio channel. The method comprises mixing the first audio signal with the at least one audio channel to generate a modified downmix signal comprising at least one modified audio channel. Furthermore, the method comprises modifying the bitstream metadata to generate modified bitstream metadata. In addition, the method comprises generating an output bitstream which comprises the modified downmix signal and the associated modified bitstream metadata, wherein the modified downmix signal and the associated modified bitstream metadata are indicative of a modified audio program comprising a plurality of modified spatially diverse audio signals.

According to another aspect, a method for inserting a first audio signal into a bitstream which comprises a downmix signal and associated bitstream metadata is described. The downmix signal and the associated bitstream metadata are indicative of an audio program comprising a plurality of spatially diverse audio signals, wherein the downmix signal comprises at least one audio channel and wherein the bitstream metadata comprises upmix metadata for reproducing the plurality of spatially diverse audio signals from the at least one audio channel. The method comprises mixing the first audio signal with the at least one audio channel to generate a modified downmix signal comprising at least one modified audio channel. Furthermore, the method comprises discarding the bitstream metadata, and generating an output bitstream comprising the modified downmix signal, wherein the output bitstream does not comprise the bitstream metadata.

According to a further aspect, an insertion unit which is configured to insert a first audio signal into a bitstream which comprises a downmix signal and associated bitstream metadata is described. The downmix signal and the associated bitstream metadata are indicative of an audio program comprising a plurality of spatially diverse audio signals. The downmix signal comprises at least one audio channel and the bitstream metadata comprises upmix metadata for reproducing the plurality of spatially diverse audio signals from the at least one audio channel. The insertion unit is configured to mix the first audio signal with the at least one audio channel to generate a modified downmix signal comprising at least one modified audio channel, and to modify the bitstream metadata to generate modified bitstream metadata. Furthermore, the insertion unit is configured to generate an output bitstream comprising the modified downmix signal and the associated modified bitstream metadata, wherein the modified downmix signal and the associated modified bitstream metadata are indicative of a modified audio program comprising a plurality of modified spatially diverse audio signals.

According to a further aspect, an insertion unit configured to insert a first audio signal into a bitstream which comprises a downmix signal and associated bitstream metadata is described. The downmix signal and associated bitstream metadata are indicative of an audio program comprising a plurality of spatially diverse audio signals, wherein the downmix signal comprises at least one audio channel and wherein the bitstream metadata comprises upmix metadata for reproducing the plurality of spatially diverse audio signals from the at least one audio channel. The insertion unit is configured to mix the first audio signal with the at least one audio channel to generate a modified downmix signal comprising at least one modified audio channel, and to discard the bitstream metadata. Furthermore, the insertion unit is configured to generate an output bitstream comprising the modified downmix signal, wherein the output bitstream does not comprise the bitstream metadata.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

SHORT DESCRIPTION OF THE FIGURES

Figure 2:
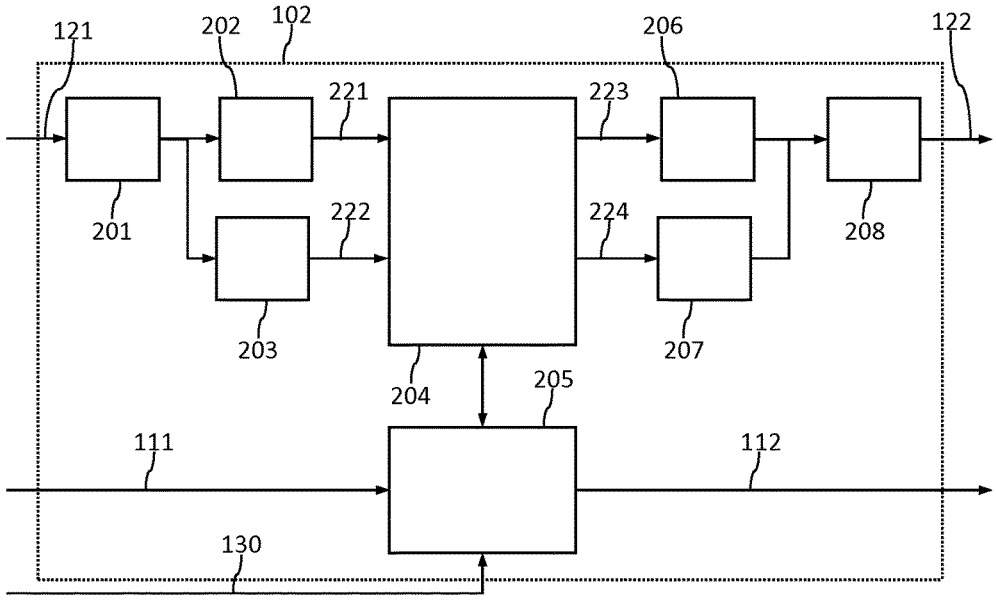
Figure 3:
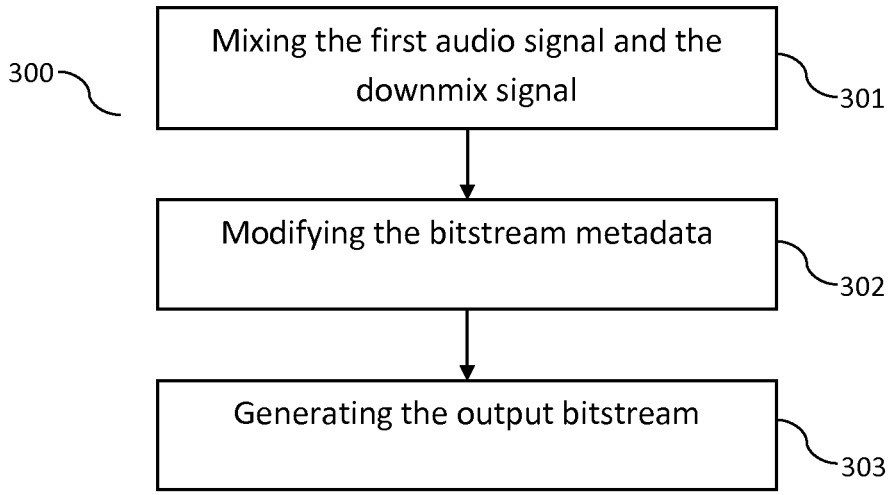

The invention is explained below in an exemplary manner with reference to the accompanying drawings, wherein FIG. 1 shows a block diagram of a transmission chain for a bandwidth efficient transmission of a plurality of audio objects;

FIG. 2 shows a block diagram of an insertion unit for inserting an audio signal into a bitstream comprising a downmix audio signal which is indicative of a plurality of audio objects; and FIG. 3 shows a flow chart of an example method for inserting an audio signal into a bitstream comprising a downmix audio signal which is indicative of a plurality of audio objects.

DETAILED DESCRIPTION

As indicated above, the present document is directed at providing methods and systems for inserting an additional audio signal (referred to herein as the first audio signal) into a bitstream which comprises a downmix audio signal that is indicative of a plurality of audio objects. FIG. 1 shows a block diagram of a transmission chain 100 for an audio program which comprises a plurality of audio objects. The transmission chain 100 comprises an encoder 101, an insertion unit 102 and a decoder 103. The encoder 101 may e.g. be positioned at a distributer of video/audio content. The video/audio content may be provided to a settop box (STB), e.g. at the home of a user, wherein the STB enables the user to select particular video/audio content from a database of the distributer. The selected video/audio content may then be sent by the encoder 101 to the STB and may then be provided to a decoder 103, e.g. to the decoder 103 of a television set or of a home theater.

During the selection process, the STB may require the insertion of system sounds into the video/audio content which is currently provided to the decoder 103. The STB may make use of the insertion unit 102 described in the present document for inserting an audio signal (e.g. a system sound) into the bitstream which has been received by the encoder 101 and which is to be provided to the decoder 103.

The encoder 101 may receive an audio program comprising a plurality of audio objects, wherein an audio object comprises an audio signal 110 and associated object audio metadata (OAMD) 120. The OAMD 120 typically describes a time-varying position of a source of the audio signal 110 within a 3-dimensional rendering environment, whereas the audio signal 110 comprises the actual audio data which is to be rendered. An audio object is thus defined by the combination of the audio signal 110 and the associated OAMD 120.

The encoder 101 is configured to downmix a plurality of audio objects 110, 120 to generate a downmix audio signal 111 (e.g. a 2 channel, a 5.1 channel or a 7.1 channel downmix signal). Furthermore, the encoder 101 provides bitstream metadata 121 which allows a corresponding decoder 103 to reconstruct the plurality of audio objects 110, 120 from the downmix audio signal 111. For this purpose, the bitstream metadata 121 typically comprises a plurality of upmix parameters (also referred to herein as Joint Object Coding, JOC, metadata or upmix metadata). Furthermore, the bitstream metadata 121 typically comprises the OAMD 120 of the plurality of audio objects, 110, 120 (which is also referred to herein as object metadata).

The downmix signal 111 and the bitstream metadata 121 may be provided to the insertion unit 102 which is configured to insert one or more audio signals 130 and which is configured to provide a modified downmix signal 112 and modified bitstream metadata 122, such that the modified downmix signal 112 and the modified bitstream metadata 122 comprise the one or more inserted audio signals 130. The one or more inserted audio signals 130 may e.g. comprise system sounds of an STB. The modified downmix signal 112/bitstream metadata 122 may be provided to the decoder 103 which generates a plurality of modified audio objects 113, 123 from the modified downmix signal 112/bitstream metadata 122. The plurality of modified audio objects 113, 123 also comprises the one or more inserted audio signals 130, such that the one or more inserted audio signals 130 are perceived when the plurality of modified audio objects 113, 123 is rendered within a 3-dimensional rendering environment.

FIG. 2 shows a block diagram of an example insertion unit 102. The insertion unit 102 comprises an audio mixer 205 which is configured to mix the downmix signal 111 with the audio signal 130 that is to be inserted, in order to provide the modified downmix signal 112. Furthermore, the insertion unit 102 comprises a metadata modification unit 204, which is configured to adapt the bitstream metadata 121 to provide the modified bitstream metadata 122. For this purpose, the insertion unit 102 may comprise a metadata decoder 201 as well as a JOC unpacking unit 202 and an OAMD unpacking unit 203, to provide the JOC metadata 221 (i.e. the upmix metadata) and the OAMD 222 (i.e. the object metadata) to the metadata modification unit 204. The metadata modification unit 204 provides modified JOC metadata 223 (i.e. modified upmix metadata) and modified OAMD 224 (i.e. modified object metadata) which is packed in units 206, 207, respectively and which is coded in the metadata coder 208 to provide the modified bitstream metadata 122.

In the present document, the insertion of a system sound 130 into a downmix signal 111 is described in the context of a downmix signal 111 which is indicative of a plurality of audio objects 110, 120. It should be noted that the insertion scheme is also applicable to downmix signals 111 which are indicative of a multi-channel audio signal. By way of example, a two channel downmix signal 111 may be indicative of a 5.1 channel audio signal. The upmix/JOC metadata 221 may be used to reconstruct or decode the 5.1 channel audio signal from the two channel downmix signal 111.

As such, the insertion scheme is applicable in general to a downmix signal which is indicative of an audio program comprising a plurality of spatially diverse audio signals 110, 120. The downmix signal 111 may comprise at least one audio channel. Furthermore, upmix metadata 221 may be provided to reconstruct the plurality of spatially diverse audio signals 110, 120 from the at least one audio channel of the downmix signal 111. Typically, the number N of audio channels of the downmix signal 111 is smaller than the number M of spatially diverse audio signals of the audio program. Hence, the audio program (i.e. the plurality of spatially diverse audio signals) typically has an increased spatial diversity compared to the downmix signal 111.

Examples for the plurality of spatially diverse audio signals 110, 120 are a plurality of audio objects 110, 120 as outlined above. Alternatively or in addition, the plurality of spatially diverse audio signals 110, 120 may comprise a plurality of audio channels of a multi-channel audio signal (e.g. a 5.1 or a 7.1 signal).

FIG. 3 shows a flow chart of an example method 300 for inserting a first audio signal 130 into a bitstream which comprises a downmix signal 111 and associated bitstream metadata 121. By way of example, the bitstream is a Dolby Digital Plus bitstream. The method 300 may be executed by the insertion unit 102 (e.g. by an STB comprising the insertion unit 102). The first audio signal 130 may comprise a system sound of an STB.

The downmix signal 111 and the associated bitstream metadata 121 are indicative of an audio program comprising a plurality of spatially diverse audio signals (e.g. audio objects) 110, 120. The format of the bitstream may be such that the number of spatially diverse audio signals 110, 120 which are comprised within an audio program is limited to a pre-determined maximum number M (e.g. M greater or equal to 10).

The downmix signal 111 comprises at least one audio channel, e.g. a mono signal, a stereo signal, a 5.1 multi-channel signal or a 7.1 multi-channel signal. As such, the downmix signal 111 may comprise a multi-channel audio signal which comprises a plurality of audio channels. By way of example, a stereo signal comprises N=2 audio channels, a 5.1 signal typically comprises N=5 audio channels (the LFE channel is typically treated separately) and the 7.1 signal typically comprises N=7 audio channels. The at least one audio channel of the downmix signal 111 may be rendered within a downmix reproduction environment. The downmix reproduction environment may be tailored to the spatial diversity which is provided by the downmix signal 111. By way of example, in case of a mono signal, the downmix reproduction environment may comprise a single loudspeaker and in case of a multi-channel audio signal, the downmix reproduction environment may comprise respective loudspeakers for the channels of the multi-channel audio signal. In particular, the audio channels of a multi-channel audio signal may be assigned to loudspeakers at particular loudspeaker positions within such a downmix reproduction environment. In a particular example, the downmix reproduction environment may be a 2-dimensional reproduction environment which may not be able to render audio signals at different heights.

The bitstream metadata 121 comprises upmix metadata 221 (which is also referred to herein as JOC metadata) for reproducing the plurality of spatially diverse audio signals 110, 120 of the audio program from the at least one audio channel, i.e. from the downmix signal 111. The bitstream metadata 121 and in particular the upmix metadata 221 may be time-variant and/or frequency variant. In particular, the upmix metadata 221 may comprise a set of coefficients which changes along the time line. The set of coefficients may comprise subsets of coefficients for different frequency subbands of the downmix signal 111. As such, the upmix metadata 221 may define time- and frequency-variant upmix matrices for upmixing different subbands of the downmix signal 111 into corresponding different subbands of a plurality of reconstructed spatially diverse audio signals (corresponding to the plurality of original spatially diverse audio signals 110, 120).

As outlined above, the plurality of spatially diverse audio signals may comprise or may be a plurality of audio objects 110, 120. The bitstream metadata 121 may comprise object metadata 222 (also referred to herein as OAMD) which is indicative of the (time-variant) positions (e.g. coordinates) of the plurality of audio objects 110, 120 within a 3-dimensional reproduction environment. The 3-dimensional reproduction environment may be configured to render audio signals/audio objects at different heights. For this purpose, the 3-dimensional reproduction environment may comprise loudspeakers which are positioned at different heights and/or which are positioned at the ceiling of the reproduction environment.

As such, the downmix signal 111 and the bitstream metadata 121 may provide a bandwidth efficient representation of an audio program which comprises a plurality of spatially diverse audio signals (e.g. audio objects) 110, 120. As indicated above, the number M of spatially diverse audio signals may be higher than the number N of audio channels of the downmix signal 111, thereby allowing for a bitrate reduction. Due to the reduced number of signals/channels, the downmix signal 111 typically has a lower spatial diversity than the plurality of spatially diverse audio signals 110, 120 of the audio program.

The method 300 comprises mixing 301 the first audio signal 130 with the at least one audio channel of the downmix signal 111 to generate a modified downmix signal 112 comprising at least one modified audio signal. In particular, the samples of audio data of the first audio signal 130 may be mixed with samples of one or more audio channels of the downmix signal 111. The modified downmix signal 112 may be adapted for rendering within the downmix reproduction environment (such as the original multi-channel audio signal).

Furthermore, the method 300 comprises modifying 302 the bitstream metadata 121 to generate modified bitstream metadata 122. The bitstream metadata 121 may be modified such that the modified downmix signal 112 and the associated modified bitstream metadata 122 are indicative of a modified audio program comprising a plurality of modified spatially diverse audio signals 113, 123. By modifying the bitstream metadata 121, it may be ensured that the insertion of the first audio signal 130 into the modified downmix signal 112 does not generate audible artifacts during the upmixing and rendering process at a corresponding decoder 103. In particular, the bitstream metadata 121 may be modified such that the reconstruction and rendering of the plurality of modified spatially diverse audio signals 113, 123 at a decoder 103 does not lead to audible artifacts. Furthermore, the modification of the bitstream metadata 121 ensures that the resulting modified audio program still comprises valid spatially diverse audio signals (notably audio objects) 113, 123. In particular, a decoder 103 may continuously operate within an object rendering mode (even when system sounds are being inserted and rendered). Such continuous operation may be beneficial with regards to the reduction of audible artifacts.

In addition, the method 300 comprises generating 303 an output bitstream which comprises the modified downmix signal 112 and the associated modified bitstream metadata 122. This output bitstream may be provided to a decoder 103 for decoding (i.e. upmixing) and rendering.

As such, it may be ensured that the system sounds of an STB may be inserted into a running audio program in an efficient manner with reduced or no audible artifacts.

The bitstream metadata 121 may be modified by replacing the upmix metadata 221 with modified upmix metadata 223, such that the modified upmix metadata 223 reproduces one or more modified spatially diverse audio signals (e.g. audio objects) 113, 123 which correspond to the one or more modified audio channels of the modified downmix signal 112, respectively. In particular, the modified upmix metadata 223 may be generated such that during the upmixing process at a decoder 103, the one or more modified audio channels of the modified downmix signal 112 are upmixed into a corresponding one or more modified spatially diverse audio signals 113, 123, wherein the positions of the one or more modified spatially diverse audio signals 113, 123 correspond to the loudspeaker positions of the one or more modified audio channels.

Hence, a one-to-one correspondence between a modified audio channel and a modified spatially diverse audio signal 113, 123 may be provided by the modified upmix metadata 223. The modified upmix metadata 223 may be such that a modified spatially diverse audio signals 113, 123 from the plurality of modified spatially diverse audio signals 113, 123 corresponds to a modified audio channel from the one or more modified audio channels (according to such a one-to-one correspondence).

If the original audio program comprises a number M of spatially diverse audio signals which exceeds the number N of modified audio channels of the modified downmix signal 112, the plurality of modified spatially diverse audio signals may be generated such that the modified spatially diverse audio signals which are in excess of N (i.e. M-N spatially diverse audio signals) are muted. Hence, the modified upmix metadata 223 may be such that a number N of modified spatially diverse audio signals 113, 123 which are not muted corresponds to the number N of modified audio channels of the modified downmix signal 112.

Table 1 shows example coefficients of an upmix matrix U which may be comprised within the modified upmix metadata 223. In the illustrated example, the upmix matrix U is a M×5 matrix which is configured to provide the M spatially diverse audio signals (e.g. audio objects) Y from the N=5 channel downmix signal X 112, as Y=UX. This matrix operation may be performed within each of a plurality of frequency bands. In Table 1 and in the following description, reference is made to audio objects. It should be noted that within the present document, audio objects are only an example for spatially diverse audio signals.

TABLE 1

| | L | R | C | Ls | Rs |
|---|---|---|---|---|---|
| Object 1 | 1 | 0 | 0 | 0 | 0 |
| Object 2 | 0 | 1 | 0 | 0 | 0 |
| Object 3 | 0 | 0 | 1 | 0 | 0 |
| Object 4 | 0 | 0 | 0 | 1 | 0 |
| Object 5 | 0 | 0 | 0 | 0 | 1 |
| Object 6 | 0 | 0 | 0 | 0 | 0 |
| . . . | . . . | . . . | . . . | . . . | . . . |
| Object M | 0 | 0 | 0 | 0 | 0 |

Table 1 shows example modified upmix metadata 223 (i.e. modified JOC coefficients) for a modified 5.1 downmix signal 112, which are used for the insertion of the first audio signal 130. The JOC coefficients are typically applicable to different frequency subbands. It can be seen that the L(eft) channel of the modified multi-channel signal is assigned to the modified audio object 1, etc. Furthermore, the modified audio objects 6 to M are not used (or muted) in the example of Table 1 (as the upmix coefficients for the objects 6 to M are set to zero.

It should be noted that there are various ways for selecting the upmix coefficients (also referred to as JOC coefficients) for the modified audio objects N+1 up to M. As shown in Table 1, the upmix coefficients for these objects may be set to zero, thereby muting these audio objects. This provides a reliable and efficient way for avoiding artifacts during the playback of system sounds. On the other hand, for a downmix signal with no elevated channels, this leads to the effect that elevated audio content is muted during the playback of system sounds. In other words, elevated audio content "falls downs" to a 2-dimensional playback scenario.

As an alternative, the original upmix coefficients of the original upmix matrix comprised within the (original) upmix metadata 221 may be maintained or attenuated (e.g. using a constant gain for all upmix coefficients) for the audio objects N+1 up to M. As a result of this, elevated audio content may be maintained during playback of system sounds.

On the other hand, as a result of a modification of the upmix coefficients for the audio objects 1 to N, the elevated audio content is included into the modified audio objects 1 to N. Hence, by maintaining the (possibly attenuated) upmix coefficients for the audio objects N+1 to M, the audio content of the audio objects N+1 to M is reproduced twice, via the modified audio objects 1 to N and via the original objects N+1 to M. This may cause combing artifacts and spatial dislocation of audio objects.

In order to overcome the latter drawbacks, only those audio objects from the audio objects N+1 up to M may be muted which have zero elevation, i.e. which are within the reproduction plane of the downmix signal 111, because the audio objects which are at the level of the downmix signal are reproduced faithfully by the modified downmix signal 112. The upmix coefficients of the audio objects N+1 up to M which are elevated with respect to the downmix signal 111 may be maintained (possibly in an attenuated manner).

In other words, modifying 302 the bitstream metadata 121 may comprise identifying a modified spatially diverse audio signal 113, 123 that none of the N audio channels has been assigned to and that can be rendered within the downmix reproduction environment used for rendering the modified downmix signal 112. Furthermore, modified bitstream metadata 122 may be generated which mutes the identified modified spatially diverse audio signal 113, 123. By doing this, combing artifacts and spatial dislocation may be avoided.

Alternatively or in addition, the spatially diverse audio signals (notably the objects) N+1 up to M may be muted by using modified object metadata 224 (i.e. modified OAMD) for these modified audio objects. In particular, an "object present" bit may be set (e.g. to zero) in order to indicate that the objects N+1 up to M are not present.

As indicated above, in case of an audio program which comprises audio objects 110, 120, the bitstream metadata 121 typically comprises object metadata 222 for the plurality of audio objects 110, 120. The object metadata 222 of an audio object 110, 120 may be indicative of a position (e.g. coordinates) of the audio object 110, 120 within a 3-dimensional reproduction environment. As such, the object metadata 222 may also comprise height information regarding the position of an audio object 110, 120. On the other hand, the downmix signal 111 and the modified downmix signal 112 may be audio signals which are reproducible within a limited downmix reproduction environment (e.g. a 2-dimensional reproduction environment which typically does not allow for the reproduction of audio signals at different heights). The bitstream metadata 121 may be modified by modifying the object metadata 222 to yield modified object metadata 224 of the modified bitstream metadata 122, such that the modified object metadata 224 of a modified audio object 113, 123 is indicative of a position of the modified audio object 113, 123 within the downmix reproduction environment. In particular, heights information comprised within the (original) object metadata 222 may be removed or leveled.

In particular, the object metadata 222 of an audio object 110, 120 may be modified such that the corresponding modified object metadata 223 is indicative of a position of the modified audio object 113, 123 at a pre-determined height (e.g. ground level). The pre-determined height may be the same for all modified audio objects 113, 123.

The modified downmix signal 112 comprises at least one modified audio channels. A modified audio channel from the at least one modified audio channel may be assigned to a corresponding loudspeaker position of the downmix reproduction environment. Example loudspeaker positions are L (left), R (right), C (center), Ls (left surround) and Rs (right surround). Each of the modified audio channels may be assigned to a different one of a plurality of loudspeaker positions of the downmix reproduction environment. The modified object metadata 224 of a modified audio object 113, 123 may be indicative of a loudspeaker position of the downmix reproduction environment. In particular, a modified audio object 113, 123 which corresponds to a modified audio channel may be positioned at the loudspeaker location of a multi-channel reproduction environment using the associated modified object metadata 224.

As indicated above, the plurality of modified audio objects 113, 123 may comprise a dedicated modified audio object 113, 123 for each of the plurality of modified audio channels (e.g. objects 1 to 5 for the audio channels 1 to 5, as shown in Table 1). Each of the one or more modified audio channels may be assigned to a corresponding different loudspeaker position of the downmix reproduction environment. Furthermore, for each of the dedicated modified audio objects 113, 123, the modified object metadata 224 may be indicative of the corresponding different loudspeaker position.

TABLE 2

| | x | y | z |
|---|---|---|---|
| Object 1 | 0.0 | 0.0 | 0.0 |
| Object 2 | 1.0 | 0.0 | 0.0 |
| Object 3 | 0.5 | 0.0 | 0.0 |
| Object 4 | 0.0 | 1.0 | 0.0 |
| Object 5 | 1.0 | 1.0 | 0.0 |
| Object 6 | $x_6$ | $y_6$ | $z_6$ |
| . . . | . . . | . . . | . . . |
| Object M | $x_M$ | $y_M$ | $z_M$ |

Table 2 indicates example modified object metadata 224 for a 5.1 modified downmix signal 112. It can be seen that the objects 1 to 5 are assigned to particular positions which correspond to the loudspeaker positions of a 5.1 reproduction environment (i.e. the downmix reproduction environment). The positions of the other objects 6 to M may be undefined (e.g. arbitrary or unchanged), because the other objects 6 to M may be muted.

The downmix signal 111 and the modified downmix signal 112 may comprise N audio channels, with N being an integer. N may be one, such that the downmix signals 111, 112 are mono signals. Alternatively, N may be greater than one, such that the downmix signals 111, 112 are multi-channel audio signals. The bitstream metadata 121 may be modified by generating modified bitstream metadata 122 which assigns each of the N audio channels of the modified downmix signal 112 to a respective modified audio object 113, 123.

Furthermore, modified bitstream metadata 122 may be generated which mutes a modified audio object 113, 123 that none of the N audio channels has been assigned to. In particular, the modified bitstream metadata 122 may be generated such that all remaining modified audio objects 113, 123 are muted.

The mixing of the one or more audio channels of the downmix signal 111 and of the first audio signal may be performed such that the first audio signal 130 is mixed with one or more of the audio channels to yield the one or more modified audio channels of the modified downmix signal 112. By way of example, the one or more audio channels may comprise a center channel for a loudspeaker at a center position of the downmix reproduction environment and the first audio signal may be mixed (e.g. only) with the center channel. Alternatively, the first audio signal may be mixed (e.g. equally) with all of a plurality of audio channels of the downmix signal 111. As such, the first audio signal may be mixed such that the first audio signal may be well perceived within the modified audio program.

Overall, it should be noted that the insertion method 300 described herein allows for an efficient mixing of a first audio signal into a bitstream which comprises a downmix signal 111 and associated bitstream metadata 121. It should be noted that the first audio signal may also comprise a multi-channel audio signal (e.g. a stereo or 5.1 signal). In an example, the downmix signal 111 comprises a stereo or a 5.1 channel signal. The first audio signal 130 comprises a stereo signal. In such a case, a left channel of the first audio signal 130 may be mixed with a left channel of the downmix signal 111 and a right channel of the first audio signal 130 may be mixed with a right channel of the downmix signal 111. In another example, the downmix signal 111 comprises a 5.1 channel signal and the first audio signal 130 also comprises a 5.1 channel signal. In such a case, channels of the first audio signal 130 may be mixed with respective ones of the downmix signal 111.

Overall, the insertion method 300 which is described in the present document exhibits low computational complexity and provides for a robust insertion of the first audio signal with little to no audible artifacts.

The method 300 may comprise detecting that the first audio signal 130 is to be inserted. By way of example, an STB may inform the insertion unit 102 about the insertion of a system sound using a flag. Prior to inserting the first audio signal 130 or at the onset of inserting the first audio signal 130, the bitstream metadata 121 may be cross-faded towards modified bitstream metadata 122 which is to be used while playing back the first audio signal 130. In particular, the modified bitstream metadata 122 which is used during playback of the first audio signal 130 may correspond to fixed target bitstream metadata 122 (notably fixed target upmix metadata 223). This target bitstream metadata 122 may be fixed (i.e. time-invariant) during the insertion time period of the first audio signal. The bitstream metadata 121 may be modified by cross-fading the bitstream metadata 121 over a pre-determined time interval into the target bitstream metadata. By way of example, the modified bitstream metadata 122 (in particular, the modified upmix metadata 223) may be generated by determining a weighted average between the (original) bitstream metadata 122 and the target bitstream metadata, wherein the weights change towards the target bitstream metadata within the pre-determined time interval. As such, cross-fading of the bitstream metadata 121 may be performed during the onset of a system sound. By performing a cross-fading of bitstream metadata, audible artifacts due to the insertion of the first audio signal may be further reduced.

The method 300 may further comprise detecting that insertion of the first audio signal 130 is to be terminated. The detection may be performed based on a flag (e.g. a flag from a STB) which indicates that the insertion of the first audio signal 130 is to be terminated. Subject to termination of the insertion of the first audio signal 130, the output bitstream may be generated such that the output bitstream includes the downmix signal 111 and the associated bitstream metadata 121. In other words, the modification of the bitstream (and in particular, the modification of the bitstream metadata 121) may only be performed during an insertion time period of the first audio signal 130.

As indicated above, during insertion of the first audio signal 130, the modified bitstream metadata 122 may correspond to fixed target bitstream metadata 122. Subject to termination of the insertion of the first audio signal 130, the bitstream metadata 121 may be modified by cross-fading the modified bitstream metadata 122 over a pre-determined time interval from the target bitstream metadata into the bitstream metadata 121. Again such cross-fading may further reduce audible artifacts caused by the insertion of the first audio signal.

The method 300 may comprise defining a first modified spatially diverse audio signal (notably a first modified audio object) 113, 123 for the first audio signal 130. In other words, the first audio signal 130 may be considered as an audio object which is positioned at a particular position within the 3-dimensional rendering environment. By way of example, the first audio signal may be assigned to a center position of the 3-dimensional rendering environment. The first audio signal 130 may be mixed with the downmix signal 111 and the bitstream metadata 121 may be modified, such that the modified audio program comprises the first modified audio object 113, 123 as one of the plurality of modified audio objects 113, 123 of the modified audio program.

The method 300 may further comprise determining the plurality of modified audio objects 113, 123 other than the first modified audio object 113, 123 based on the plurality of audio objects 110, 120. In particular, the plurality of modified audio objects 113, 123 other than the first modified audio object 113, 123 may be determined by copying an audio object 110, 120 to a modified audio object 113, 123 (without modification).

The insertion of a first modified audio object may be performed by assigning the first modified audio object to a particular audio channel of the modified downmix signal 112. Furthermore, modified object metadata 224 for the first modified audio object may be added to the modified bitstream metadata 122. Furthermore, upmix coefficients for reconstructing the first modified audio object from the modified downmix signal 112 may be added to the modified upmix metadata 223. As such, the insertion of a first modified audio object may be performed by separate processing of the audio data and of the metadata. In particular, the insertion of a first modified audio object may be performed with low computational complexity.

By way of example, a mono system sound 130 may be mixed into the downmix 111, 121. In particular, the system sound 130 may be mixed into the center channel of a 5.1 downmix signal 111. Furthermore, the first object (object 1) may be assigned to a "system sound object". The upmix coefficients associated with the system sound object (i.e. the first row of the upmix matrix) may be set to [0 0 1 0 0] (given the typical 5.1 channel order L, R, C, Ls, Rs). The positional OAMD for the system sound object may be set to x=0.5 y=0.0, z=0.0.

As an alternative to a separate processing of the audio data (i.e. the downmix signal 111) and the metadata (i.e. the bitstream metadata 121) a combined processing of the audio data and the metadata for inserting the first audio signal 130 may be performed. By doing this, audible artifacts which are caused by the insertion of the first audio signal 130 may be further reduced (typically at the expense of an increased computational complexity). In particular, the modified audio program may e.g. be generated by upmixing the downmix signal 111 using the bitstream metadata 121 to generate a plurality of reconstructed spatially diverse audio signals (e.g. audio objects) which correspond to the plurality of spatially diverse audio signals 110, 120. In other words, the downmix signal 111 and the bitstream metadata 121 may be decoded. Furthermore, the plurality of modified spatially diverse audio signals 113, 123 other than a first modified audio object 113, 123 (which comprises the first audio signal 130) may be generated based on the plurality of reconstructed spatially diverse audio signals (e.g. by copying some of the reconstructed spatially diverse audio signals). Furthermore, the plurality of modified spatially diverse audio signals 113, 123 may be downmixed (or encoded) to generate the modified downmix signal 112 and the modified bitstream metadata 122.

Alternative or in addition to the above mentioned ways of inserting the first audio signal 130 and to modifying the bitstream metadata 121, the bitstream metadata 121 may be modified such that the modified audio program is indicative of the plurality of spatially diverse audio signals 110, 120 at a reduced rendering level. In particular, the rendering level may be reduced (e.g. smoothly over a pre-determined time interval), in order to increase the audibility of the first audio signal 130 within the modified audio program. Alternative or in addition, modifying 302 the bitstream metadata 121 may comprise setting a flag which is indicative of the fact that the output bitstream comprises the first audio signal 130. By doing this, a corresponding decoder 103 may be informed about the fact that the output bitstream comprises modified audio program which comprises the first audio signal 130 (e.g. which comprises a system sound). The processing of the decoder 103 may then be adapted accordingly.

An alternative method for inserting a first audio signal 130 into a bitstream which comprises a downmix signal 111 and associated bitstream metadata 121 may comprise the steps of mixing the first audio signal 130 with the one or more audio channels of the downmix signal 111 to generate a modified downmix signal 112 which comprises one or more modified audio channels. Furthermore, the bitstream metadata 121 may be discarded and an output bitstream which comprises (e.g. only) the modified downmix signal 112 and which does not comprise the bitstream metadata 121 may be generated. By doing this, the output bitstream may be converted into a bitstream of a pure one or multi-channel audio signal (at least during the insertion time period of the first audio signal 130). The decoder 103 may then switch from an object rendering mode to a multi-channel rendering mode (if such switch-over mechanism is available at the decoder 103). Such an insertion scheme is beneficial, in view of low computational complexity. However, a switch-over between the object rendering mode and the multi-channel rendering mode may cause audible artifacts during rendering (at the switch-over time instants).

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

The invention claimed is:

1. A method for inserting a first audio signal into a bitstream which comprises a downmix signal and associated bitstream metadata; wherein the downmix signal and associated bitstream metadata are indicative of an audio program comprising a plurality of spatially diverse audio signals; wherein the downmix signal comprises at least one audio channel; wherein the bitstream metadata comprises upmix metadata for reproducing the plurality of spatially diverse audio signals from the at least one audio channel; wherein the method comprises mixing the first audio signal with the downmix signal to generate a modified downmix signal comprising at least one modified audio channel;

modifying the bitstream metadata to generate modified bitstream metadata; and generating an output bitstream comprising the modified downmix signal and the associated modified bitstream metadata; wherein the modified downmix signal and associated modified bitstream metadata are indicative of a modified audio program comprising a plurality of modified spatially diverse audio signals, wherein the plurality of spatially diverse audio signals comprises a plurality of audio objects;

the plurality of modified spatially diverse audio signals comprises a plurality of modified audio objects;

the bitstream metadata comprises object metadata for the plurality of audio objects;

the object metadata of an audio object is indicative of a position of the audio object within a 3-dimensional reproduction environment;

the downmix signal and the modified downmix signal are reproducible within a downmix reproduction environment;

modifying the bitstream metadata comprises modifying the object metadata to yield modified object metadata of the modified bitstream metadata, such that the modified object metadata of a modified audio object is indicative of a position of the modified audio object within the downmix reproduction environment.

2. The method of claim 1, wherein the object metadata of an audio object is modified such that the corresponding modified object metadata is indicative of a position of the modified audio object at a pre-determined height within the 3-dimensional reproduction environment.

3. The method of claim 1, wherein modifying the bitstream metadata comprises, replacing the upmix metadata by modified upmix metadata, such that the modified upmix metadata reproduces at least one modified spatially diverse audio signal which corresponds to the at least one modified audio channel of the modified downmix signal.

4. The method of claim 1, wherein modifying the bitstream metadata comprises, replacing the upmix metadata by modified upmix metadata; and wherein the modified upmix metadata is such that a modified spatially diverse audio signal from the plurality of modified spatially diverse audio signals corresponds to a modified audio channel of the modified downmix signal.

5. The method of claim 1, wherein modifying the bitstream metadata comprises, replacing the upmix metadata by modified upmix metadata; and wherein the modified upmix metadata is such that a number N of modified spatially diverse audio signalswhich are not muted or attenuated corresponds to a number N of modified audio channels of the modified downmix signal.

6. The method of claim 1, wherein the modified downmix signal comprises a plurality of modified audio channels;

a modified audio channel from the plurality of modified audio channels is assigned to a corresponding loudspeaker position of the downmix reproduction environment; and the modified object metadata of a modified audio object is indicative of a loudspeaker position of the downmix reproduction environment.

7. The method of claim 6, wherein modifying the bitstream metadata comprises identifying a modified spatially diverse audio signal that none of the N audio channels has been assigned to and that can be rendered within a downmix reproduction environment used for rendering the modified downmix signal; and generating modified bitstream metadata which mutes the identified modified spatially diverse audio signal.

8. The method of claim 1, wherein the downmix signal and the modified downmix signal comprise N audio channels, with N being an integer, with N being greater or equal to 1; and modifying the bitstream metadata comprises generating modified bitstream metadata which assigns each of the N audio channels of the modified downmix signal to a respective modified spatially diverse audio signal.

9. The method of claim 1, wherein the downmix signal comprises a plurality of audio channels; and the first audio signal is mixed with one or more of the plurality of audio channels to yield a plurality of modified audio channels of the modified downmix signal.

10. The method of claim 1, wherein the downmix signal comprises a stereo or 5.1 channel signal;

the first audio signal comprises a stereo signal; and a left channel of the first audio signal is mixed with a left channel of the downmix signal and a right channel of the first audio signal is mixed with a right channel of the downmix signal.

11. The method of claim 1, wherein the modified bitstream metadata corresponds to fixed target bitstream metadata; and modifying the bitstream metadata comprises cross-fading the bitstream metadata over a pre-determined time interval into the target bitstream metadata.

12. The method of claim 1, wherein the method further comprises, detecting that insertion of the first audio signal is to be terminated; and subject to termination of the insertion of the first audio signal, generating the output bitstream such that the output bitstream includes the downmix signal and the associated bitstream metadata.

13. The method of claim 1, wherein the method comprises defining a first modified spatially diverse audio signal for the first audio signal; and the first audio signal is mixed with the downmix signal and the bitstream metadata is modified, such that the modified audio program comprises the first modified spatially diverse audio signal as one of the plurality of modified spatially diverse audio signals.

14. The method of claim 1, wherein the method comprises determining the plurality of modified spatially diverse audio signals other than the first modified spatially diverse audio signal based on the plurality of spatially diverse audio signal.

15. The method of claim 1, further comprising upmixing the downmix signal using the bitstream metadata to generate a plurality of reconstructed spatially diverse audio signals corresponding to the plurality of spatially diverse audio signals; and generating the plurality of modified spatially diverse audio signals other than the first modified spatially diverse audio signal based on the plurality of reconstructed spatially diverse audio signals.

16. The method of claim 1, the bitstream metadata is modified such that the modified audio program is indicative of at least one of the plurality of spatially diverse audio signals at a reduced rendering level.

17. The method of claim 1, wherein modifying the bitstream metadata comprises setting a flag indicative of the fact that the output bitstream comprises the first audio signal.

18. The method of claim 1, wherein the audio program comprises M spatially diverse audio signals;

the downmix signals comprises N audio channels; and

N is smaller than M.

19. An insertion unit configured to insert a first audio signal into a bitstream which comprises a downmix signal and associated bitstream metadata; wherein the downmix signal and associated bitstream metadata are indicative of an audio program comprising a plurality of spatially diverse audio signals; wherein the downmix signal comprises at least one audio channel; wherein the bitstream metadata comprises upmix metadata for reproducing the plurality of spatially diverse audio signals from the at least one audio channel; wherein the insertion unit is configured to mix the first audio signal with the at least one audio channel to generate a modified downmix signal comprising at least one modified audio channel;

modify the bitstream metadata to generate modified bitstream metadata; and generate an output bitstream comprising the modified downmix signal and the associated modified bitstream metadata; wherein the modified downmix signal and associated modified bitstream metadata are indicative of a modified audio program comprising a plurality of modified spatially diverse audio signals, wherein the plurality of spatially diverse audio signals comprises a plurality of audio objects;

the plurality of modified spatially diverse audio signals comprises a plurality of modified audio objects;

the bitstream metadata comprises object metadata for the plurality of audio objects;

the object metadata of an audio object is indicative of a position of the audio object within a 3-dimensional reproduction environment;

the downmix signal and the modified downmix signal are reproducible within a downmix reproduction environment;

and wherein the insertion unit is configured to modify the object metadata to yield modified object metadata of the modified bitstream metadata, such that the modified object metadata of a modified audio object is indicative of a position of the modified audio object within the downmix reproduction environment.

* * * * *